US008786500B2

(12) United States Patent
Eom et al.

(10) Patent No.: US 8,786,500 B2
(45) Date of Patent: Jul. 22, 2014

(54) BUILT-IN ANTENNA AND METHOD FOR IMPROVING ANTENNA EFFICIENCY

(75) Inventors: Sang-Jin Eom, Suwon-si (KR); Jin-Kyu Bang, Suwon-si (KR); Ho-Saeng Kim, Anyang-si (KR); Yong-Jin Kim, Seoul (KR); Jin-U Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 343 days.

(21) Appl. No.: 13/204,032

(22) Filed: Aug. 5, 2011

(65) Prior Publication Data

US 2012/0044114 A1 Feb. 23, 2012

(30) Foreign Application Priority Data

Aug. 17, 2010 (KR) ..... 10-2010-0079223

(51) Int. Cl.
*H01Q 1/24* (2006.01)

(52) U.S. Cl.
USPC ..... 343/702; 343/700 MS

(58) Field of Classification Search
USPC ..... 343/700 MS, 702, 846
See application file for complete search history.

(56) References Cited

U.S. PATENT DOCUMENTS

| | | | | |
|---|---|---|---|---|
| 2007/0115183 | A1* | 5/2007 | Kim et al. | 343/700 MS |
| 2009/0002244 | A1* | 1/2009 | Woo | 343/702 |
| 2009/0087011 | A1* | 4/2009 | Kang | 381/387 |
| 2009/0231213 | A1* | 9/2009 | Ishimiya | 343/702 |
| 2011/0021255 | A1* | 1/2011 | Kim et al. | 455/575.1 |

* cited by examiner

*Primary Examiner* — Tho G Phan
(74) *Attorney, Agent, or Firm* — Jefferson IP Law, LLP

(57) ABSTRACT

A built-in antenna of a portable terminal and a method of forming the same are provided. The built-in antenna includes a first conductor having a specific length and used for a ground, a second conductor disposed with a specific distance in parallel to the first conductor to couple with the first conductor and used for power feeding, and a separating element disposed between the first conductor and the second conductor to separate the first and second conductors. Accordingly, the built-in antenna may exhibit a smooth radiation property even if a metal construction is used in a device and thus may implement robustness improvement of the device and make the device slim and have an attractive outer appearance. In addition, a method of improving antenna efficiency may prevent deterioration of the radiation property of the antenna radiator of the related art by using simple processing, and the metal construction may be used as a radiator.

16 Claims, 20 Drawing Sheets

| GSM 850 | 17 |
|---|---|
| GSM 900 | 18 |
| DCS | 23 |
| WCDMA | 27 |

| FREQUENCY | PEAK | AVERAGE | EFFI. (%) |
|---|---|---|---|
| 824 | −6.9 | −10.4 | 9% |
| 837 | −6.2 | −.9.7 | 11% |
| 849 | −4.8 | −8.4 | 14% |
| 869 | −2.6 | −6.2 | 24% |
| 880 | −2.1 | −5.8 | 26% |
| 915 | −1.3 | −5.3 | 29% |
| 925 | −1.9 | −6.0 | 25% |
| 960 | −5.1 | −9.5 | 11% |
| 1710 | −5.8 | −9.6 | 11% |
| 1785 | −2.0 | −6.7 | 22% |
| 1805 | −1.4 | −6.9 | 20% |
| 1850 | −0.7 | −7.2 | 19% |
| 1880 | −0.2 | −7.1 | 19% |
| 1920 | 0.3 | −6.8 | 21% |
| 1930 | 0.4 | −6.7 | 22% |
| 1980 | 1.2 | −6.0 | 25% |
| 1990 | 1.2 | −5.9 | 26% |
| 2110 | 2.0 | −5.0 | 32% |
| 2170 | 2.8 | −4.5 | 35% |

| | |
|---|---|
| GSM 850 | 26 |
| GSM 900 | 28 |
| DCS | 52 |
| WCDMA | 43 |

| FREQUENCY | PEAK | AVERAGE | EFFI. (%) |
|---|---|---|---|
| 824 | −4.7 | −7.3 | 19% |
| 837 | −4.3 | −6.9 | 20% |
| 849 | −3.4 | −6.1 | 24% |
| 869 | −2.1 | −4.9 | 33% |
| 880 | −2.0 | −4.7 | 34% |
| 915 | −1.7 | −4.6 | 35% |
| 925 | −2.4 | −5.3 | 29% |
| 960 | −5.3 | −8.4 | 14% |
| 1710 | 1.1 | −4.0 | 40% |
| 1785 | 2.3 | −2.9 | 51% |
| 1805 | 2.3 | −2.8 | 53% |
| 1850 | 2.6 | −2.3 | 58% |
| 1880 | 2.4 | −2.4 | 58% |
| 1920 | 2.1 | −2.7 | 54% |
| 1930 | 1.8 | −2.7 | 53% |
| 1980 | 1.1 | −3.1 | 49% |
| 1990 | 0.9 | −3.3 | 47% |
| 2110 | −1.1 | −4.8 | 33% |
| 2170 | −1.9 | −6.4 | 23% |

<LOW-BAND EFFICIENCY : 75% IMPEDANCE MATCHING>

BUILT-IN ANTENNA AND METHOD FOR IMPROVING ANTENNA EFFICIENCY

PRIORITY

This application claims the benefit under 35 U.S.C. §119(a) of a Korean patent application filed in the Korean Intellectual Property Office on Aug. 17, 2010 and assigned Serial No. 10-2010-0079223, the entire disclosure of which is hereby incorporated by reference.

BACKGROUND OF THE INVENTION

1. Field of the Invention

The present invention relates to a built-in antenna and a method for improving antenna efficiency. More particularly, the present invention relates to a built-in antenna and a method for improving antenna efficiency in order to improve an antenna radiation property, to prevent radiation deterioration caused by a metal construction used to improve an outer appearance of a terminal, and to ensure mechanical robustness.

2. Description of the Related Art

With rapid technological advancement, a wireless communication function has been included not only in a mobile communication device but also in a portable electronic device (e.g., a media reproducing device, an electronic dictionary, a tablet, and the like), and the portable electronic device including such a wireless communication function has been used in everyday life. Portable electronic device users now prefer a smaller device having various functions. To satisfy the customers' preference, manufacturers are making an effort to decrease a size of components used in the portable electronic device and to integrate several functions into one component.

Such a change may occur equally in an antenna used to transmit and receive a radio wave. As a frequency band required for various services may be implemented by using one antenna, an effort to decrease a size of the antenna is ongoing.

A built-in antenna used in the portable electronic device of the related art is produced such that a metal layer is patterned on a circuit board so as to be used as an antenna radiator, or such that a metal sheet is patterned on a dielectric structure that supports an antenna radiator.

A Planar Inverted F Antenna (PIFA) and a monopole antenna are used as a built-in antenna widely used in a portable electronic device. These antennas have a disadvantage in that a performance-to-size relation cannot be designed in a complementary manner. More particularly, when a metal construction and a metal component are located near an antenna, there is a problem in that the antenna's radiation efficiency is decreased and a band is also decreased.

The portable electronic device of the related art has a sufficient space for placing an antenna and a sufficient separation distance to a metal portion. In addition, it is not difficult to design an antenna for the portable electronic device of the related art since an exterior of the portable electronic device is formed with a dielectric material, such as plastic. However, as the portable electronic device gradually decreases in size and thickness, a space for placing the antenna is being decreased, and a distance to the surrounding metal construction and metal component is being narrowed.

The aforementioned metal structure not only contributes to improving mechanical robustness but also improves the appearance of the portable electronic device. Therefore, there is an ongoing effort for applying this structure to a part of the portable device, more particularly, to a frame of the portable terminal.

However, it is difficult for the aforementioned built-in antenna of the related art to satisfy such a requirement as a compact size, efficiency increase, and a wide band in such extreme surrounding conditions.

In order to address this problem, antenna efficiency is implemented by using the antenna of the related art in such a manner that an antenna pattern is deployed by being spaced apart from a metal construction by a maximum distance possible in a narrow space for placing the antenna or that the metal construction existing at a portion where the antenna is located is processed with insert molding, or that a thickness of the portion where the antenna is located is increased. However, if an antenna pattern is deployed far from a metal component and a metal construction, a space for placing the antenna becomes further decreased and thus it becomes difficult to ensure more space. In addition, a method of performing an insert molding process on an antenna part impairs an outer appearance of the antenna since there is a disparity between metal and insert molding processes in a design aspect even if it is easy to ensure radiation efficiency. Furthermore, although radiation efficiency may be ensured by using a method of increasing a thickness of the portable electronic device, this method cannot make the portable terminal slim, which is a current design trend.

When the aforementioned metal construction is deployed in a front surface of the portable terminal, it has been used by being connected to a main ground. Such a structure exhibits a typical radiation deterioration phenomenon. That is, if there is a metal structure extended from the ground in the front surface of the antenna, a near field induces current in a corresponding metal member and generates thermal loss and radiation loss together with lossy volume, thereby resulting in an overall radiation efficiency deterioration.

To address such problems, a method in which a metal portion of an antenna is processed with insert molding and the remaining portions of a front surface of the antenna are subjected to metal processing has been used. However, this method has a problem in that a disparity occurs between metal and insert molding processes in a design aspect. A method in which the entire front surface of the device is subjected to metal processing and a distance between an antenna and the front-surface metal member is increased to the maximum extent possible by increasing a thickness of the terminal has a problem in that a slimming trend in the designing of the terminal cannot be satisfied. A method in which a front-surface metal member of a terminal is separated from a main ground can utilize the front-surface metal as a radiator, but may cause an Electro-Static Discharge (ESD) problem or a problem of radiation efficiency deterioration due to user influence.

Therefore, a need exists for a built-in antenna implemented to have a wide bandwidth and a method for improving antenna efficiency.

SUMMARY OF THE INVENTION

Aspects of the present invention are to address at least the above-mentioned problems and/or disadvantages and to provide at least the advantages described below. Accordingly, an aspect of the present invention is to provide a built-in antenna implemented to have a wide bandwidth and an excellent radiation property even if a metal construction exists, and a method and an apparatus for improving antenna efficiency.

Another aspect of the present invention is to provide a built-in antenna implemented to make a terminal slim and robust by deploying a metal construction at a desired position while implementing excellent radiation efficiency of the antenna, and a method of improving antenna efficiency.

Another aspect of the present invention is to provide a built-in antenna implemented to prevent deterioration of a radiation property of an antenna by processing a metal construction and utilizing the metal construction as an antenna radiator, and a method of improving antenna efficiency.

In accordance with an aspect of the present invention, a built-in antenna of a portable terminal is provided. The built-in antenna includes a first conductor having a specific length and used for a ground, a second conductor disposed with a specific distance in parallel to the first conductor to couple with the first conductor and used for power feeding, and a separating element disposed between the first conductor and the second conductor to separate the first and second conductors.

The first conductor and the second conductor may have various cross-sectional shapes under a condition that the two conductors are disposed in parallel, and may also have various shapes in a lengthwise direction. Such a condition shall further improve a radiation property while minimizing an antenna radiator.

The aforementioned lengthwise coupling-type built-in antenna may prevent radiation property deterioration caused by a metal frame used as a part of the portable terminal. This is because the sufficient lengthwise coupling between the first conductor and the second conductor generates significantly great capacitance, and thus minimizes an influence of a surrounding metal.

An exemplary embodiment of the present invention provides a method of preventing a built-in antenna against radiation property deterioration caused by a metal construction used in a terminal.

In accordance with an aspect of the present invention, a method of forming a high efficiency antenna in a portable terminal is provided. The method includes forming a metal construction in a portion of the portable terminal, and forming a built-in antenna radiator inside the portable terminal around the metal construction, wherein at least one portion of the metal construction around the built-in antenna radiator is cut to have a slightly open structure so that the metal construction operates as an extended ground and an antenna radiator.

The open structure is preferably applied to a metal construction closest in distance to a feed portion of the antenna radiator.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, like reference numerals will be understood to refer to like parts, components and structures.

DETAILED DESCRIPTION OF EXEMPLARY EMBODIMENTS

Figure 1:
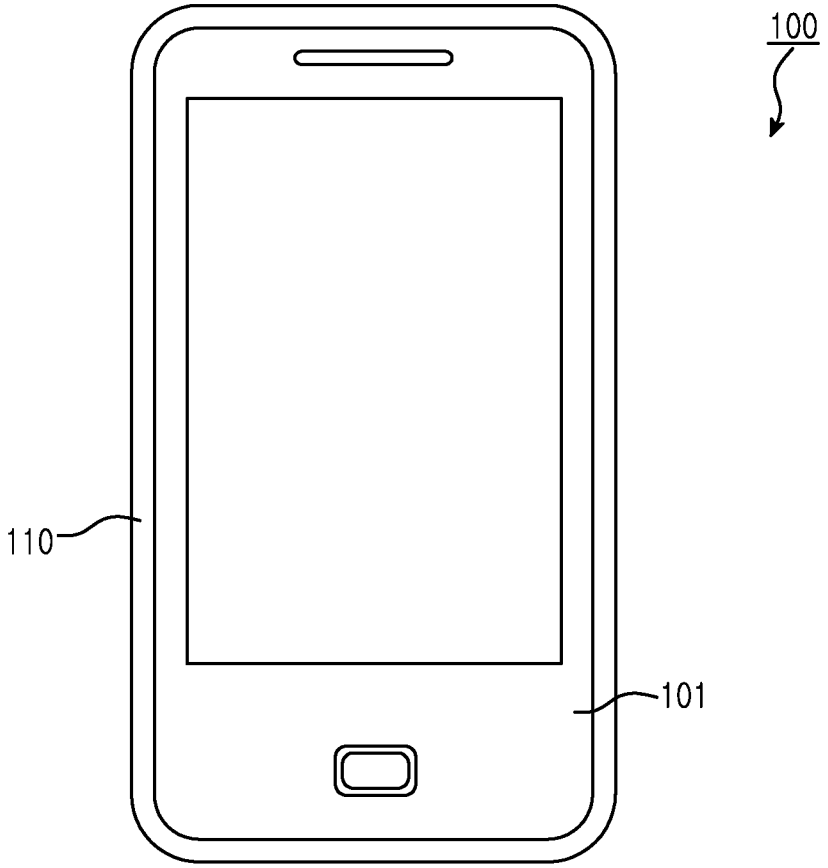
FIG. 1 illustrates a portable terminal employing a built-in antenna according to an exemplary embodiment of the present invention.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a", "an", and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

FIGS. 1 through 16, discussed below, and the various exemplary embodiments of the present invention provided are by way of illustration only and should not be construed in any way that would limit the scope of the present invention. Those skilled in the art will understand that the principles of the present disclosure may be implemented in any suitably arranged communications system. The terms used to describe various exemplary embodiments of the present invention are provided to merely aid the understanding of the description, and that their use and definitions in no way limit the scope of the invention. Terms first, second, and the like are used to differentiate between objects having the same terminology and are in no way intended to represent a chronological order, unless where explicitly stated otherwise. A set is defined as a non-empty set including at least one element.

Although a portable terminal illustrated in the following exemplary embodiments of the present invention is a bar-type terminal, exemplary embodiments of the present invention are not limited thereto. Exemplary embodiments of the present invention may be applied to various types of terminals, for example, a terminal in which a metal frame is formed partially or fully in the terminal to provide an attractive outer appearance or to reinforce robustness.

FIG. 1 illustrates a portable terminal employing a built-in antenna according to an exemplary embodiment of the present invention.

Referring to FIG. 1, a bar-type portable terminal 100 includes a metal frame 110 that encompasses an edge of a body 101 of the portable terminal 100. The metal frame 110 may make the portable terminal 100 have an attractive outer appearance and may also be used to reinforce robustness.

The metal frame 110, which encompasses the body 101 of the portable terminal 100 and which is disposed fully or partially to the terminal, causes radiation property deterioration and decrease in efficiency in the built-in antenna. Thus, a built-in antenna having a specific lengthwise direction (i.e., a 'rail antenna' 10 of FIG. 2) is used in exemplary embodiments of the present invention.

Figure 2:
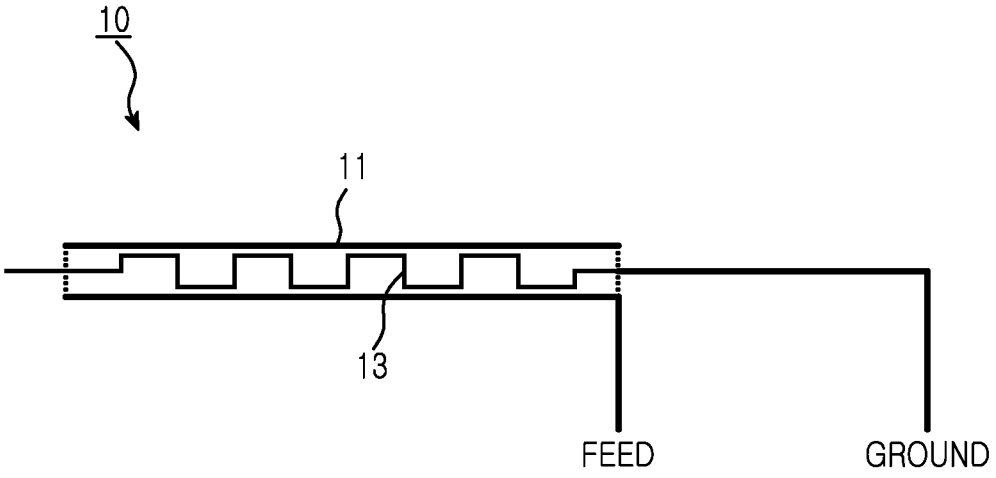
FIG. 2 is a schematic view illustrating a structure of a built-in antenna according to an exemplary embodiment of the present invention.

FIG. 2 is a schematic view illustrating a structure of a built-in antenna according to an exemplary embodiment of the present invention.

Referring to FIG. 2, a built-in antenna having a specific lengthwise direction, i.e., rail antenna 10, has a first conductor and a second conductor. The first conductor may be an inner conductor 13. The second conductor may be an outer conductor 11. The inner conductor 13 and the outer conductor 11 may be disposed in parallel. Herein, the inner conductor 13 is electrically connected to a ground portion of the portable terminal 100, and the outer conductor 11 is electrically connected to a feed portion of the portable terminal 100. However, exemplary embodiments of the present invention are not limited thereto, and thus the ground portion may be electrically connected to the outer conductor, and the feed portion may be electrically connected to the inner conductor.

The inner conductor 13 and the outer conductor 11 are disposed in parallel in a lengthwise direction, and it is allowed to generate mutual coupling while avoiding physical contact. Therefore, a dielectric member 12 of FIG. 3 or a magnetic member may be disposed between the inner conductor 13 and the outer conductor 11 so that the inner conductor 13 and the outer conductor 11 are spaced apart from each other by a specific distance. More particularly, the dielectric member does not have to fully occupy both the inner connector and the outer connector in a lengthwise direction. Thus, the dielectric member may occupy at least one of the inner connector and the outer connector in a regular or irregular manner. A length of the inner conductor 13 is not necessarily equal to a length of the outer conductor 11, and their lengths and widths may be regulated to fit an antenna radiation property of a corresponding band.

In addition, although it is illustrated that the built-in antenna 10 is inserted such that the inner conductor 13 is inserted inside the outer conductor 11 by being spaced apart by a specific distance, exemplary embodiments of the present invention are not limited thereto. The inner conductor 13 and the outer conductor 11 may be disposed in parallel in a lengthwise direction such that the two conductors are spaced apart from each other by a specific distance by means of the dielectric member or the magnetic member.

Figure 3:
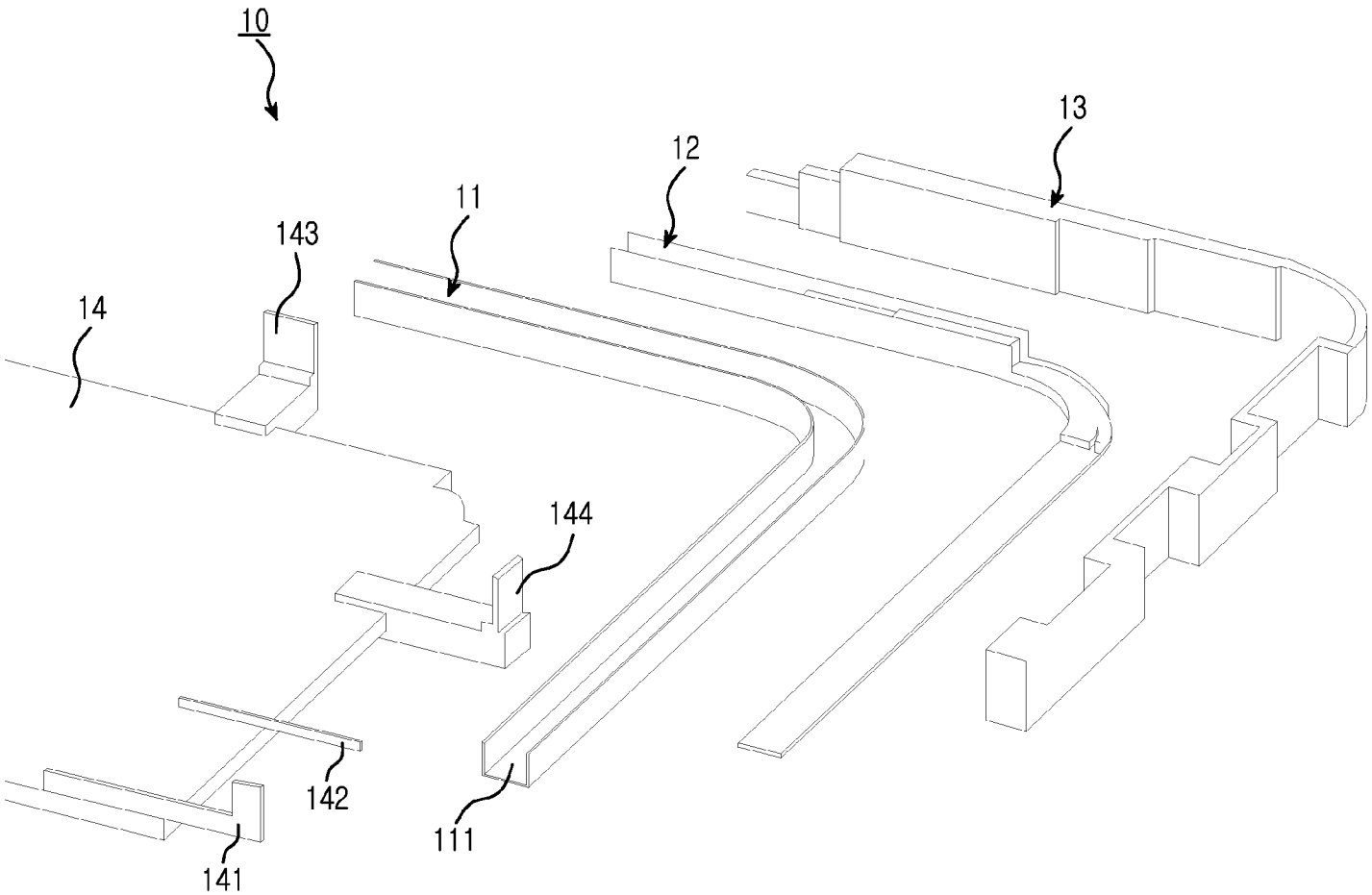
FIG. 3 is an exploded perspective view of a built-in antenna according to an exemplary embodiment of the present invention.
Figure 4:
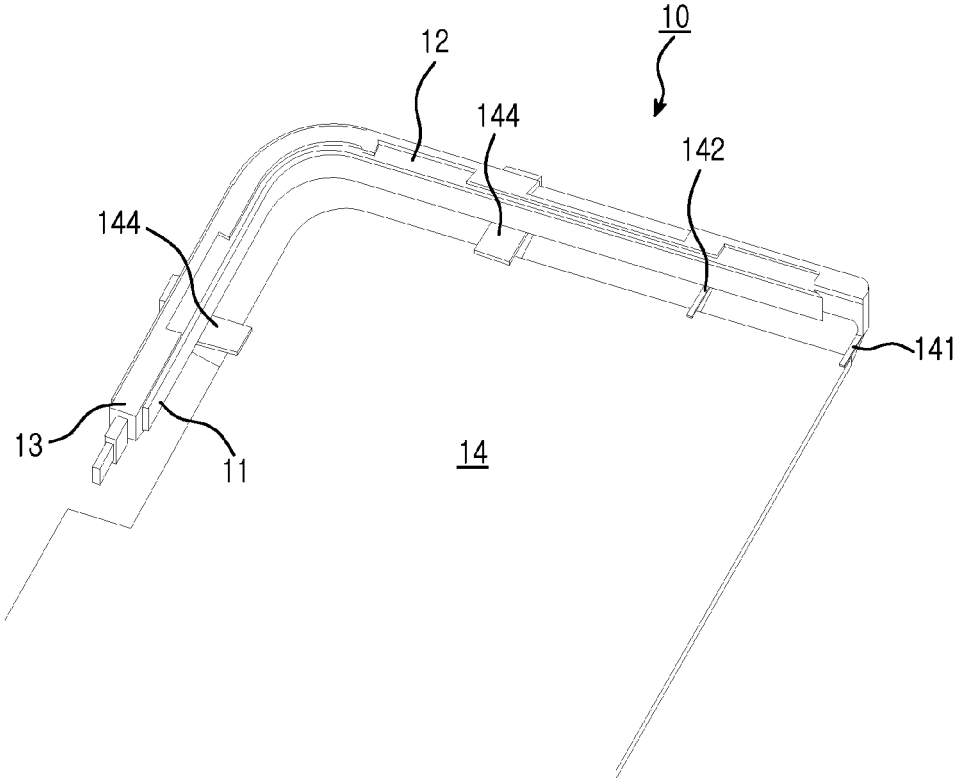
FIG. 4 is a perspective view illustrating a state in which a built-in antenna is assembled according to an exemplary embodiment of the present invention.

FIG. 3 is an exploded perspective view of a built-in antenna according to an exemplary embodiment of the present invention. FIG. 4 is a perspective view illustrating a state in which a built-in antenna is assembled according to an exemplary embodiment of the present invention.

Referring to FIGS. 3 and 4, a ground portion 141 and a feed portion 142 are installed or formed on a main board 14 of the portable terminal 100 of FIG. 1. As illustrated, the ground portion 141 and the feed portion 142 are formed in a pin type. However, they may be formed in a pattern type on the main board 14, or may be connected with a well-known Flexible Printed Circuit (FPC).

In addition, one or more support members 143 and 144 may be installed in a protrusion manner on the main board 14 to support a built-in antenna 10. However, exemplary embodiments of the present invention are not limited thereto, and thus an inner conductor 13 or an outer conductor 11 may be fixed by performing bonding directly on the main board without having to use the support members 143 and 144.

The outer conductor 11 includes a 'U'-shaped slot or slit 111, and is bent in a curved shape along a bending surface of the main board 14. The inner conductor 13 is disposed to the slit 111 of the outer conductor 11 in a lengthwise direction in a mounted manner. In this case, the inner conductor 13 and the outer conductor 11 do not physically contact with each other, and for this structure, a dielectric member (e.g., a resin) or a magnetic member or a hybrid-type block is disposed between the inner conductor 13 and the outer conductor 11. The dielectric member 12 or the magnetic member may be partially disposed in at least one portion between the inner conductor 13 and the outer conductor 11 in order to avoid thermal loss.

The inner conductor 13 may be formed in various shapes, which may facilitate extension of a ground area. The dielectric member 12 or the magnetic member may be further disposed to encompass or support the conductor. In addition to the dielectric member and the magnetic member, various shapes, such as a hybrid block shape, may also be used. In addition, the inner conductor 13 and/or the outer conductor 11 may be installed in an insert molding manner to the dielectric material 12.

Therefore, the inner conductor 13 is electrically connected to the ground portion 141 of the main board 14 of the portable terminal 100, and the outer conductor 11 is electrically connected to the feed portion 142 of the main board 14 of the portable terminal 100. However, exemplary embodiments of the present invention are not limited thereto, and thus the outer conductor 11 may be electrically connected to the metal frame 110 to utilize the metal frame 110 as a ground member. If necessary, at least one portion of the outer metal 11 may be electrically connected to the feed portion 142, and at least one portion of the inner metal 13 may also be electrically connected to the ground portion 141. Alternatively, at least one portion of the outer metal and at least one portion of the inner metal may be connected to the feed portion or the ground portion, respectively.

Consequently, the antenna (or rail antenna) 10 may implement a built-in antenna radiator operating with a desired antenna radiation pattern and a relatively wide frequency band by minimizing an influence (i.e., by avoiding influence) of a surrounding metal portion (i.e., metal frame) due to very large capacitance between an oscillation metal portion and a coupling metal portion.

As illustrated, the inner metal 13 and the outer metal 11 are bent in a curved shape along a bending portion of the main board 14. However, exemplary embodiments of the present invention are not limited thereto, and thus they may be deployed in a linear shape if a desired antenna radiation pattern is sufficiently implemented.

Figure 5A:
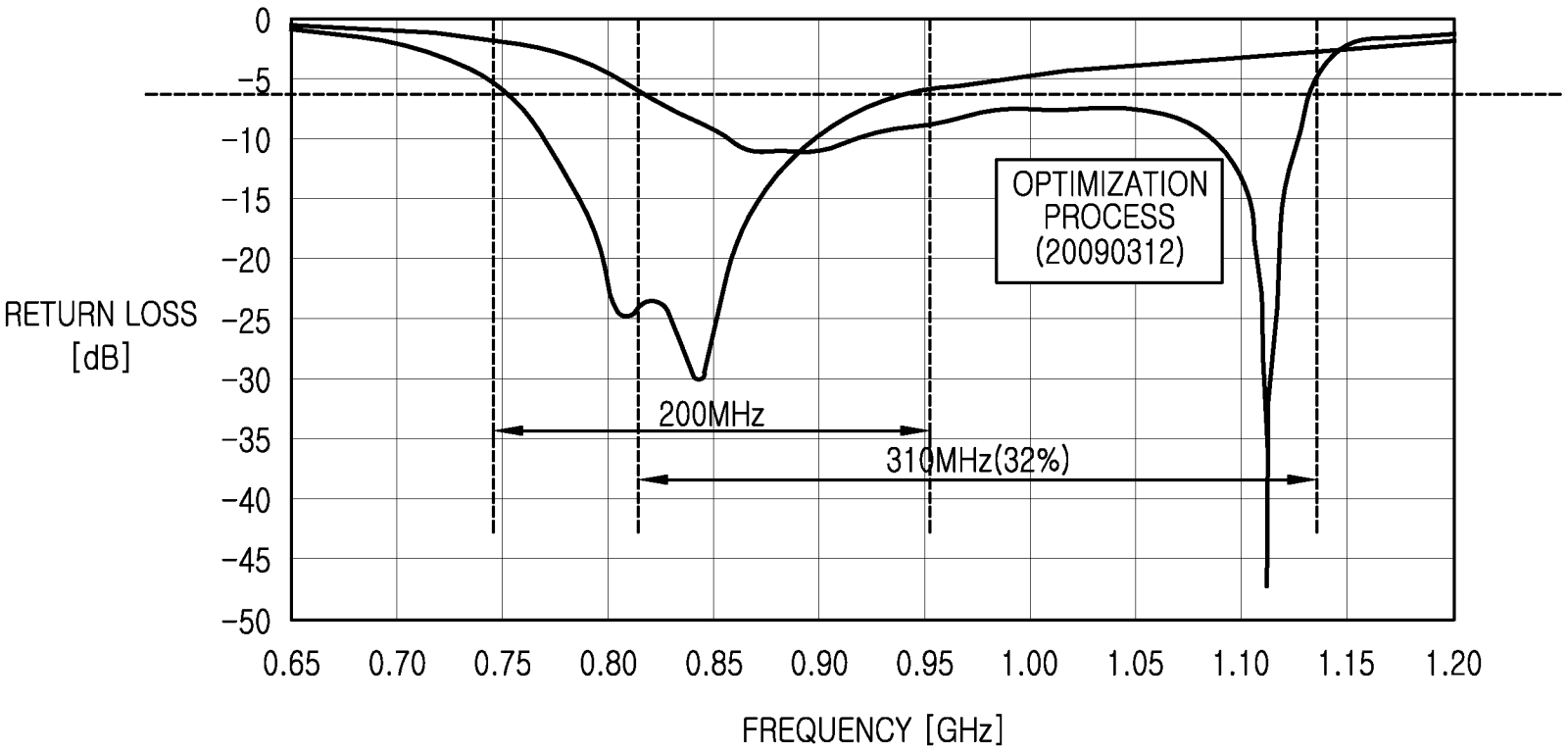
FIG. 5A illustrates a radiation loss and a bandwidth change before and after an optimization process according to an exemplary embodiment of the present invention.
Figure 5B:
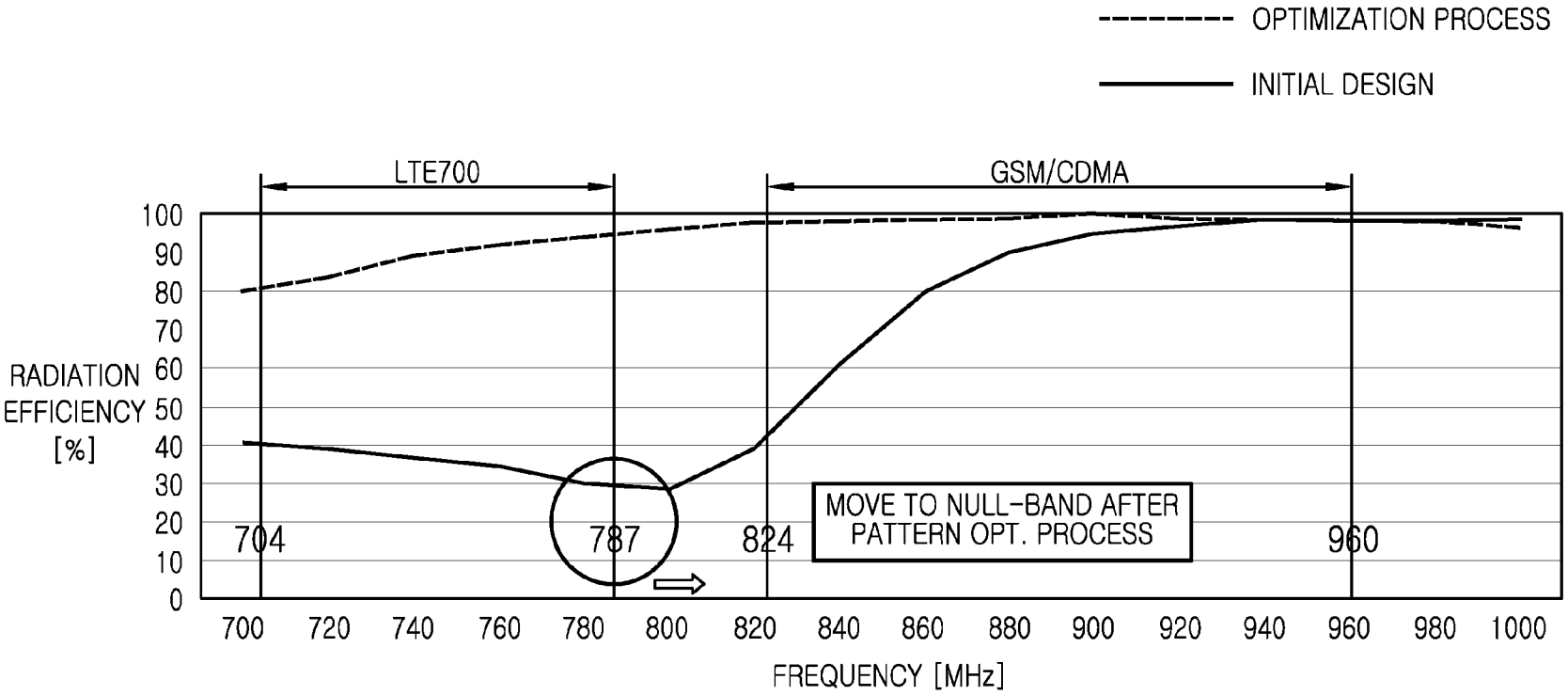
FIG. 5B illustrates radiation efficiency before and after an optimization process of a built-in antenna according to an exemplary embodiment of the present invention.

FIG. 5A illustrates a radiation loss and a bandwidth change before and after an optimization process according to an exemplary embodiment of the present invention. FIG. 5B illustrates radiation efficiency before and after an optimization process of a built-in antenna according to an exemplary embodiment of the present invention.

Herein, the optimization process is a process in which a length, shape, or the like of inner and outer conductors is taken into account, a width, the number, or the like of dielectric members is determined, and an optimal radiation property of an optimal antenna radiator is regulated by using a matching circuit, or the like, in a contact line of a feed portion and/or a ground portion.

Referring to FIG. 5A, a bandwidth is about 200 MHz before optimization and is extended by about 310 MHz from 810 MHz to 1120 MHz after optimization. In this case, the bandwidth is extended about 32% with respect to before optimization.

Referring to FIG. 5B, radiation efficiency is improved by at least 80% or more at a desired band (i.e., Long Term Evolution (LTE) 700 and Global System for Mobile (GSM) communication/Code Division Multiple Access (CDMA) bands) after optimization.

Figure 6A:
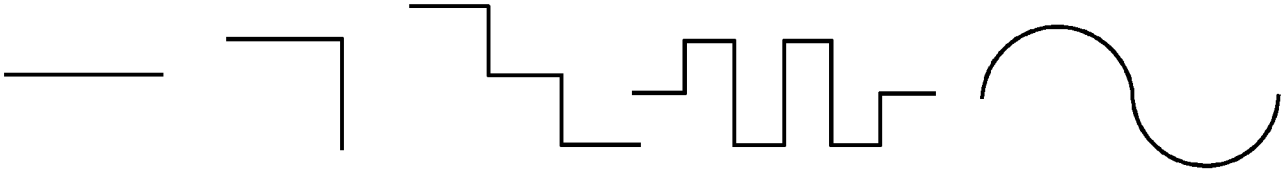
FIGS. 6A through 6C illustrate various shapes of a built-in antenna according to exemplary embodiments of the present invention.
Figure 6B:
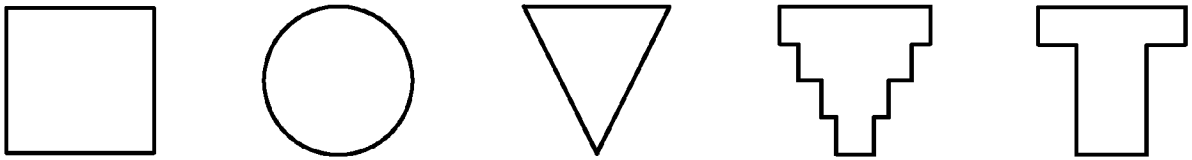
Figure 6C:
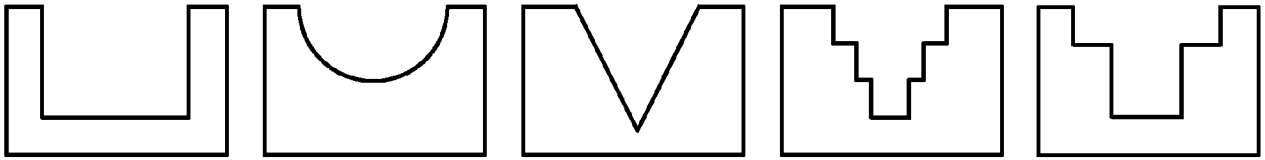

FIGS. 6A through 6C illustrate various shapes of a built-in antenna according to exemplary embodiments of the present invention.

Referring to FIG. 6A, the antenna of exemplary embodiments of the present invention may be implemented in various shapes. Examples of the various shapes include a single-curved shape, a multi-curved shape, a shape having a concavo-convex structure, a shape having a reverse curve, etc.

Referring to FIG. 6B, a cross-section of an inner metal may have various shapes, such as a rectangular shape, a circular shape, an inverted triangular shape, a cascade inverted triangular shape, etc. Shapes of FIG. 6C may also be applied to an outer metal.

Figure 7:
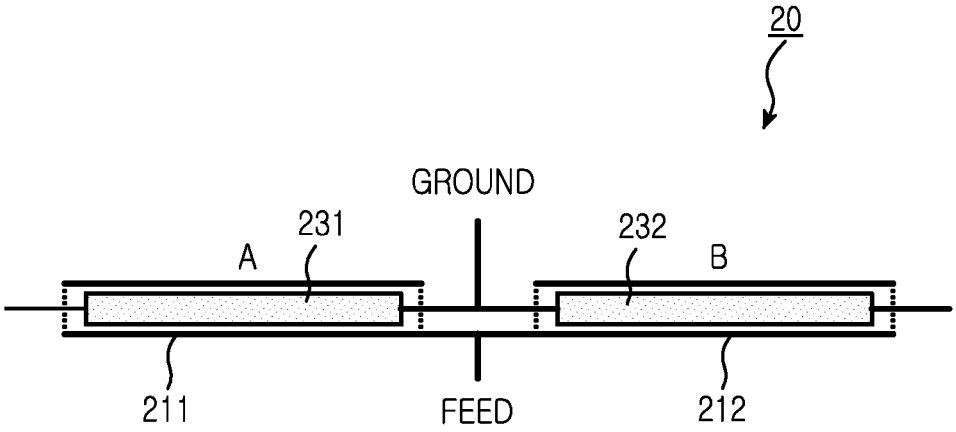
FIG. 7 is a schematic view illustrating a structure of an antenna according to an exemplary embodiment of the present invention.

FIG. 7 is a schematic view illustrating a structure of an antenna according to an exemplary embodiment of the present invention.

The built-in antenna 10 having a single band has been described above in an exemplary embodiment of the present invention. In FIGS. 7 through 10, a built-in antenna 20 having multiple bands is illustrated. However, an outer metal basically having a specific length and an inner metal disposed in parallel to the outer metal may have similar structures. A plurality of dielectric members, magnetic members, or hybrid type blocks is used to form capacitance having a specific magnitude by coupling the outer metal and the inner metal in a non-contact manner.

Referring to FIG. 7, the outer metal is formed in an integral manner, but includes a first radiation portion 211 operating relatively at a low frequency band and a second radiation portion 212 operating at a high frequency band. Similarly, the inner metal is also formed in an integral manner, but a first ground portion 231 corresponding to the first radiation portion 211 and a second ground portion 232 corresponding to the second radiation portion 212 are disposed. A feed pin and a ground pin may protrude in an integral manner at the center of the respective metals.

Figure 8:
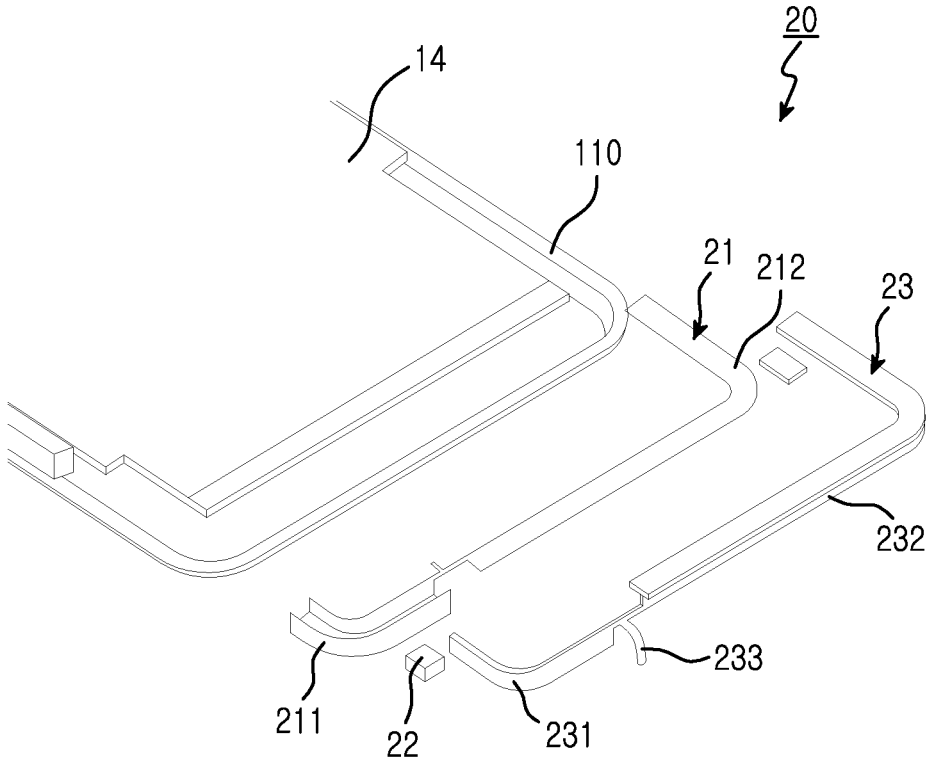
FIG. 8 is an exploded perspective view of a built-in antenna according to an exemplary embodiment of the present invention.
Figure 9:
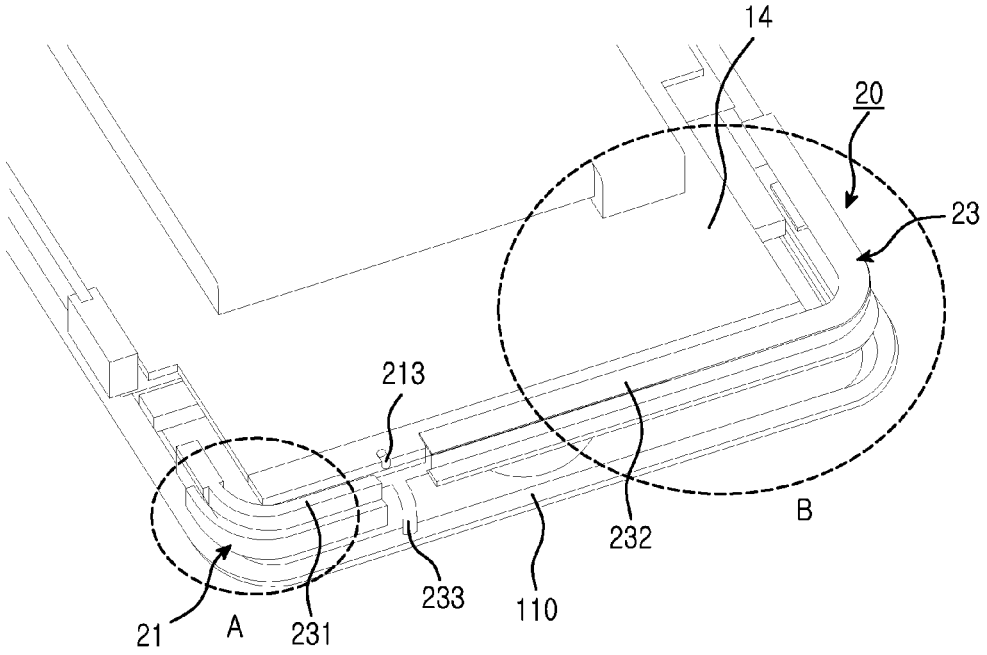
FIG. 9 is a perspective view illustrating a state in which a built-in antenna is assembled according to an exemplary embodiment of the present invention.

FIG. 8 is an exploded perspective view of a built-in antenna according to an exemplary embodiment of the present invention. FIG. 9 is a perspective view illustrating a state in which a built-in antenna is assembled according to an exemplary embodiment of the present invention. Portion A and portion B of FIG. 9 correspond to portion A and portion B of FIG. 7, respectively.

Referring to FIGS. 8 and 9, the built-in antenna operates as a multi-band antenna radiator. For example, as illustrated in FIG. 9, the portion A indicated by a dotted line operates at a relatively low frequency band, and the portion B indicated by a dotted line operates at a high frequency band. However, an inner metal 23 and an outer metal 21 in which the inner metal 23 is disposed are formed such that respective radiation regions are formed integrally.

A feed pin 213 protrudes at the center of the outer metal 21. A first radiation portion 211 and a second radiation portion 212 are extended in a lengthwise direction to the left and right sides of the feed pin 213. Similarly, a ground pin 233 protrudes at the center of the inner metal 23. With the ground pin 233 being located in the center, a first ground portion 231 and a second ground portion 232 are disposed in a lengthwise direction in parallel to the first radiation portion 211 and the second radiation portion 212. In this case, at least one dielectric member 22 having a specific size may be disposed between the inner metal 23 and the outer metal 21. Instead of the dielectric member, a magnetic member or a hybrid-type block may be disposed.

Not only a structure in which the inner metal 23 is mounted in parallel to the outer metal 21 but also a structure in which they are disposed in parallel without being joined while being spaced apart from each other by means of the dielectric member 22 may be used.

The feed pin 213 of the outer metal 21 is used to feed power to a main board 14 installed inside the portable terminal. The ground pin 233 of the inner metal 23 is grounded to a metal frame 110 used as a part of outer appearance of the portable terminal. However, exemplary embodiments of the present invention are not limited thereto, and thus the feed pin 213 may be used for power feeding not only at one point but also one or more points, and the ground pin 233 may be grounded to the main board 14 or at least one portion thereof may be ground to various surrounding conductors including the metal frame 110 of the portable terminal.

In addition, as illustrated in an exemplary embodiment of the present invention, a shape of the built-in antenna 20 or a cross-sectional shape of the inner metal 23 and its corresponding outer metal 21 may be formed in various manners. That is, the shape of the inner metal 23 may have a concavo-convex structure in which a total length is relatively short and a wider ground area may be ensured.

Figure 10A:
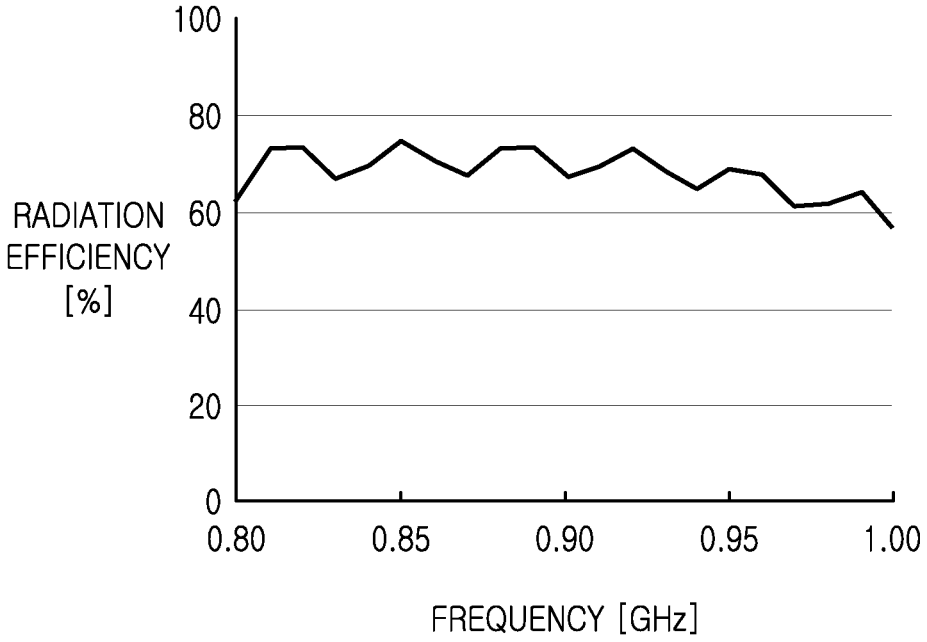
FIG. 10A illustrates radiation efficiency of a built-in antenna in a low frequency band according to an exemplary embodiment of the present invention.
Figure 10B:
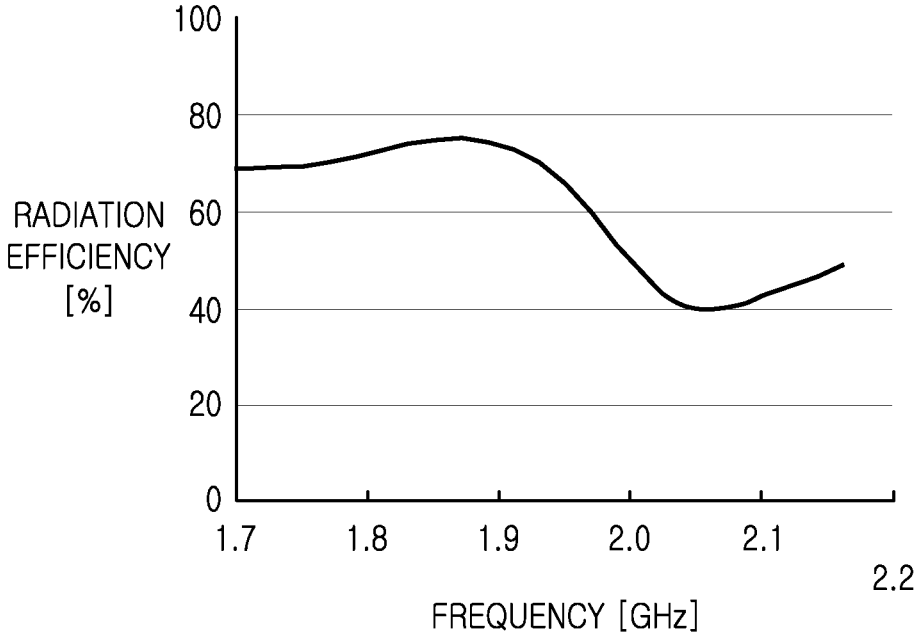
FIG. 10B illustrates radiation efficiency of a built-in antenna in a high frequency band according to an exemplary embodiment of the present invention.

FIG. 10A illustrates radiation efficiency of a built-in antenna in a low frequency band according to an exemplary embodiment of the present invention. FIG. 10B illustrates radiation efficiency of a built-in antenna in a high frequency band according to an exemplary embodiment of the present invention.

Referring to FIGS. 10A and 10B, considering that radiation efficiency is 30~40% in a built-in antenna, a radiation property is excellent, that is, the radiation efficiency is above 60% at the low frequency band and the radiation efficiency is above 40% at the high frequency band.

Figure 11:
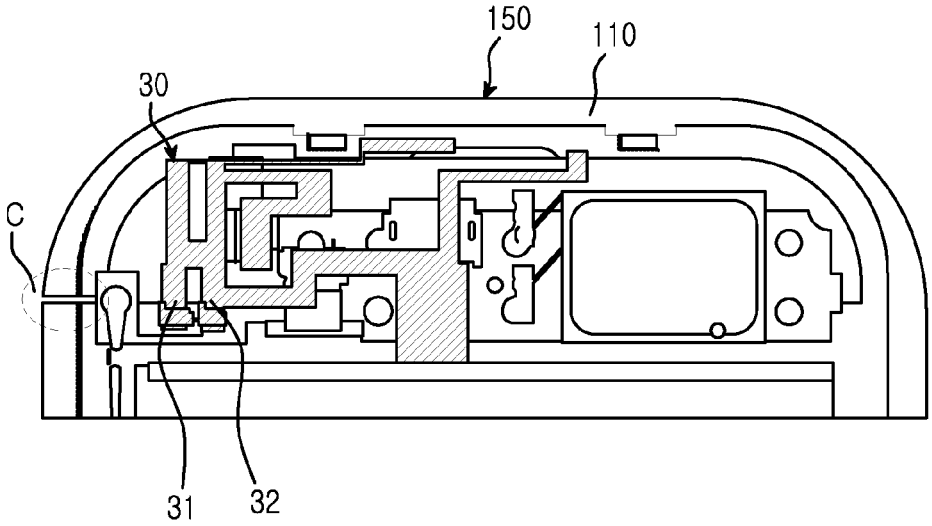
FIG. 11 illustrates a structure of a metal frame used in a built-in antenna according to an exemplary embodiment of the present invention.

FIG. 11 illustrates a structure of a metal frame used in a built-in antenna according to an exemplary embodiment of the present invention.

Referring to FIG. 11, the metal frame structure is used when a metal 110 is disposed near a position where the built-in antenna 30 is deployed. The metal frame 110 is used for the purpose of not only decoration of a portable terminal 150 but also for robustness reinforcement. However, when the (closed-loop) metal frame 110 is used around the antenna radiator 30, although there is an effect of ground extension, radiation efficiency of the built-in antenna deteriorates rapidly since the metal frame 110 operates as a scatter.

When a portion C of the metal frame around the built-in antenna 30 is formed in a slightly open structure, the structure of the metal frame may have the ground extension effect of the antenna radiator 30 while operating as an antenna radiator, thereby being able to improve radiation efficiency.

The metal frame 110 is disposed along an edge of the portable terminal 150, the built-in antenna radiator 30 is installed around the metal frame 110, and a feed portion 31 and a ground portion 32 of the built-in antenna radiator 30 are electrically connected inside the terminal. In this case, the slightly open structure is formed by cutting the metal frame portion C closest in distance to the feed portion 31, and thus a radiation property of the antenna radiator 30 is improved.

Figure 12A:
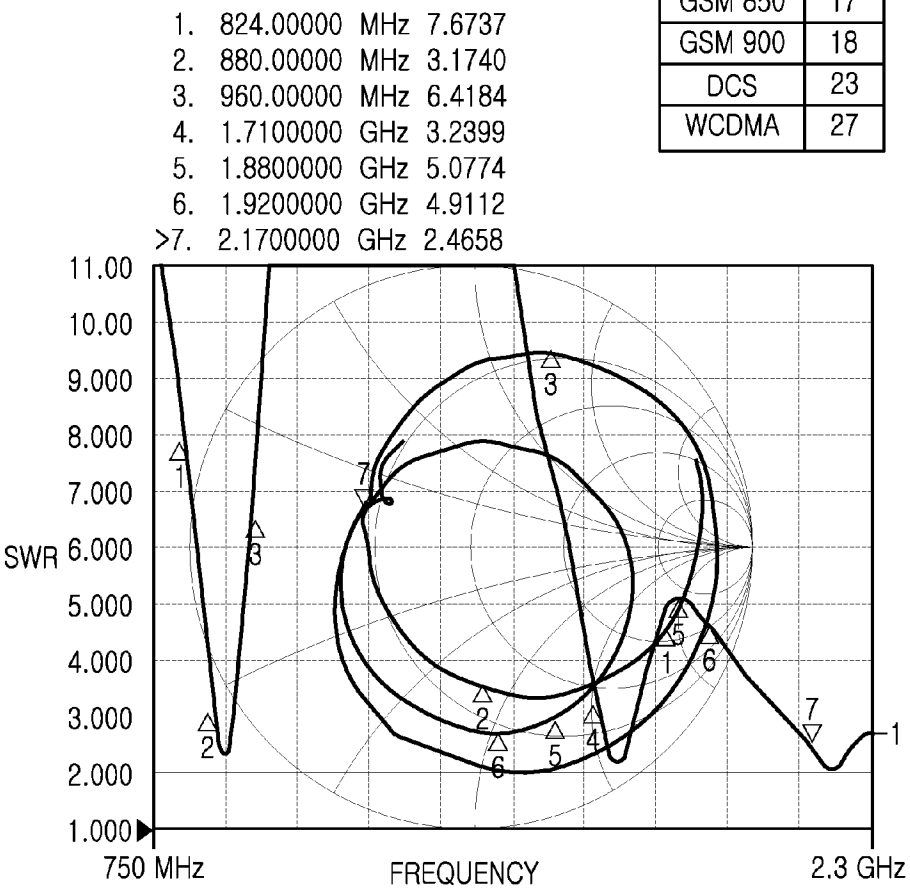
FIG.12A (RELATED ART)
FIG. 12A illustrates radiation efficiency of an antenna radiator of a metal frame with a closed structure according to the related art.
Figure 12B:
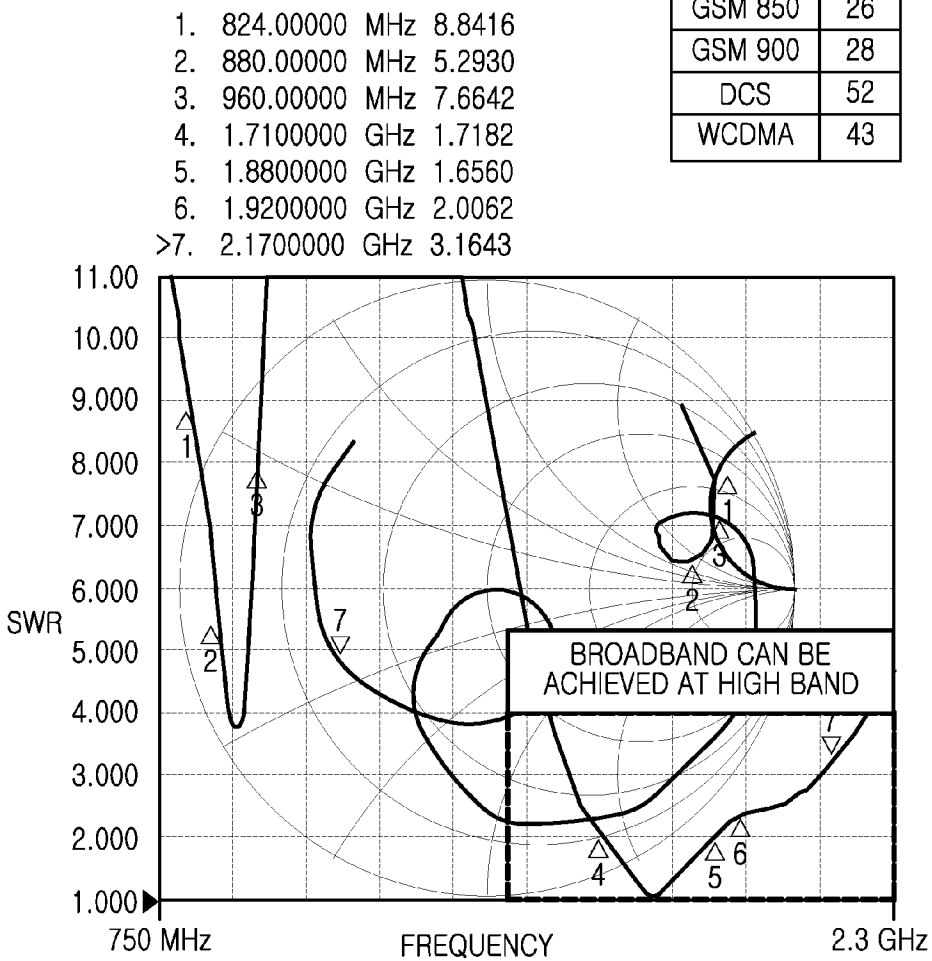
FIG. 12B illustrates radiation efficiency of an antenna radiator of a metal frame with a slightly open structure according to an exemplary embodiment of the present invention.

FIG. 12A illustrates radiation efficiency of an antenna radiator of a metal frame with a closed structure according to the related art. FIG. 12B illustrates radiation efficiency of an antenna radiator of a metal frame with a slightly open structure according to an exemplary embodiment of the present invention.

Referring to FIG. 12A, an antenna radiator using a metal frame with the closed structure of the related art has radiation efficiency of 17%, 18%, 23%, and 27% respectively at GSM 850, GSM 900, Digital Cellular Service (DCS), and CDMA bands. On the other hand, referring to FIG. 12B, an antenna radiator using a metal frame with a slightly open structure of exemplary embodiments of the present invention has radiation efficiency of 26%, 28%, 52%, and 43% respectively at GSM 850, GSM 900, DCS, and CDMA bands, which shows improvement in the radiation efficiency. Referring to a radiation pattern of the left side of each figure, it may be seen that a broadband is implemented at a high frequency band.

Figure 13A:
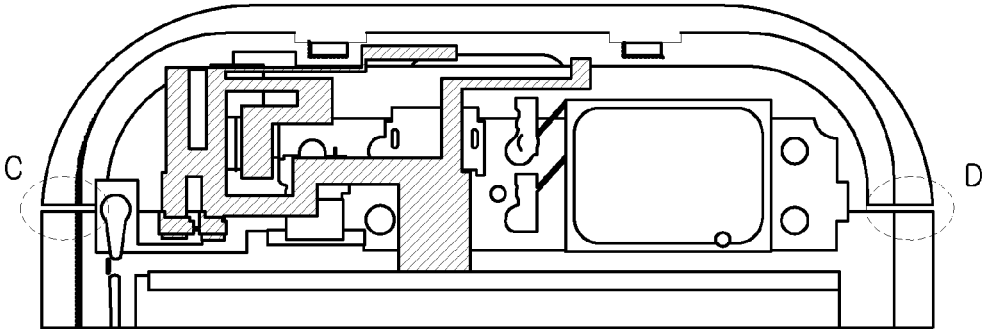
FIGS. 13A through 13C illustrate various metal frame structures according to exemplary embodiments of the present invention.
Figure 13B:
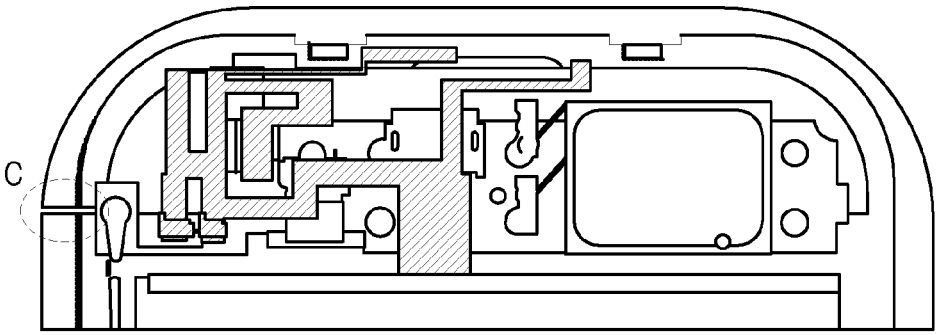
Figure 13C:
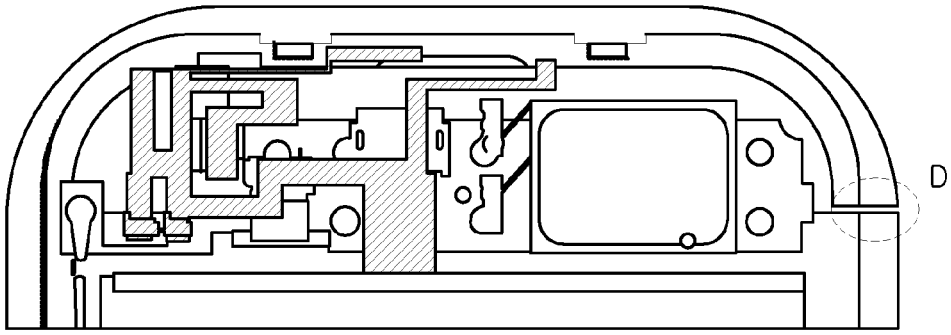

FIGS. 13A through 13C illustrate various metal frame structures according to exemplary embodiments of the present invention.

Referring to FIG. 13A, both the left and right sides of the metal frame are cut. This is a slightly open structure in which a left portion C closest in distance to a feed portion and a right portion D having a maximum separation distance to the feed portion are cut together.

Referring to FIG. 13B, the same structure of FIG. 11 is used.

Referring to FIG. 13C, this is a slightly open structure in which only a right portion D having a maximum separation distance to the feed portion is cut.

Figure 14A:
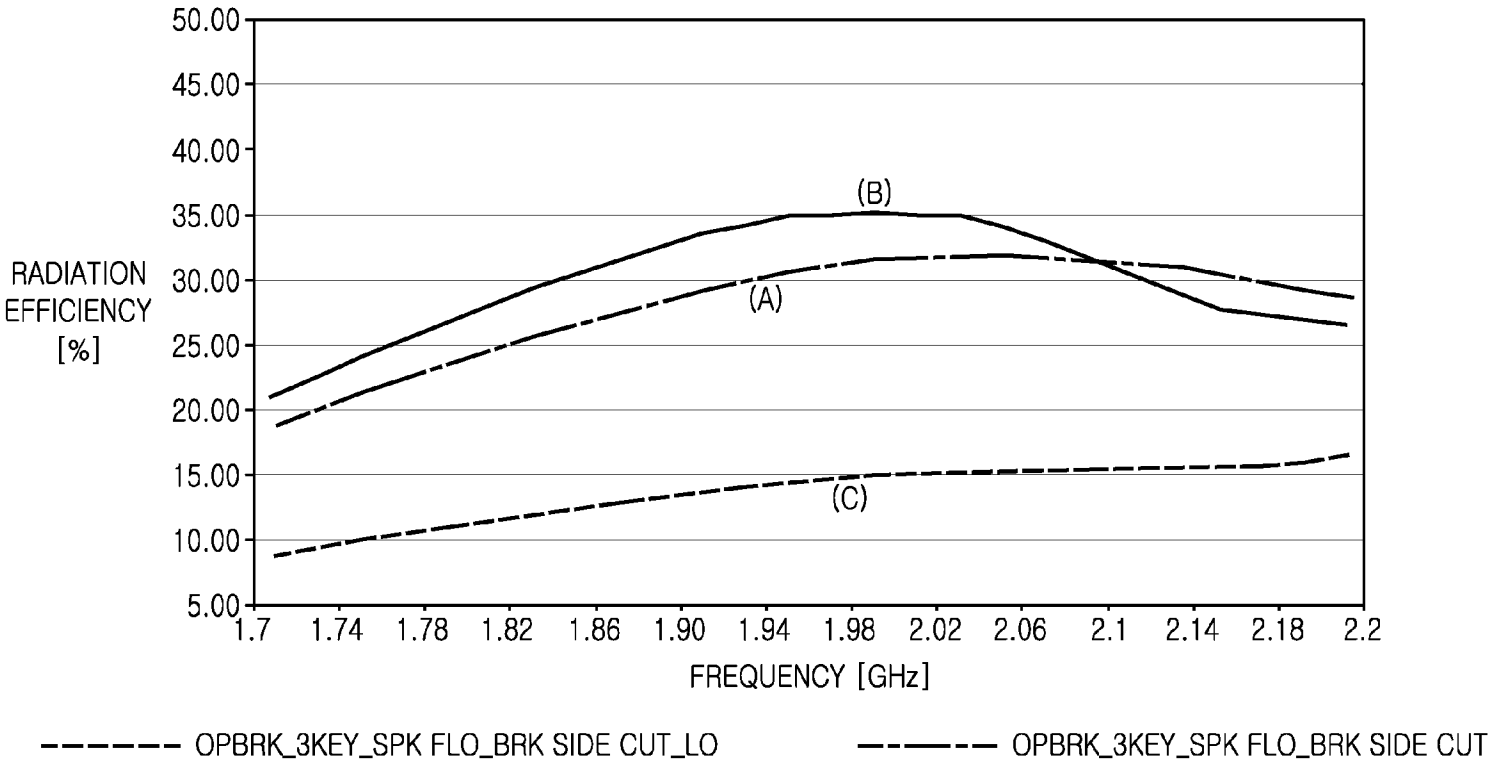
FIGS. 14A and 14B illustrate radiation efficiency for each frequency band of an antenna radiator with respect to different metal frame structures according to exemplary embodiments of the present invention.
Figure 14B:
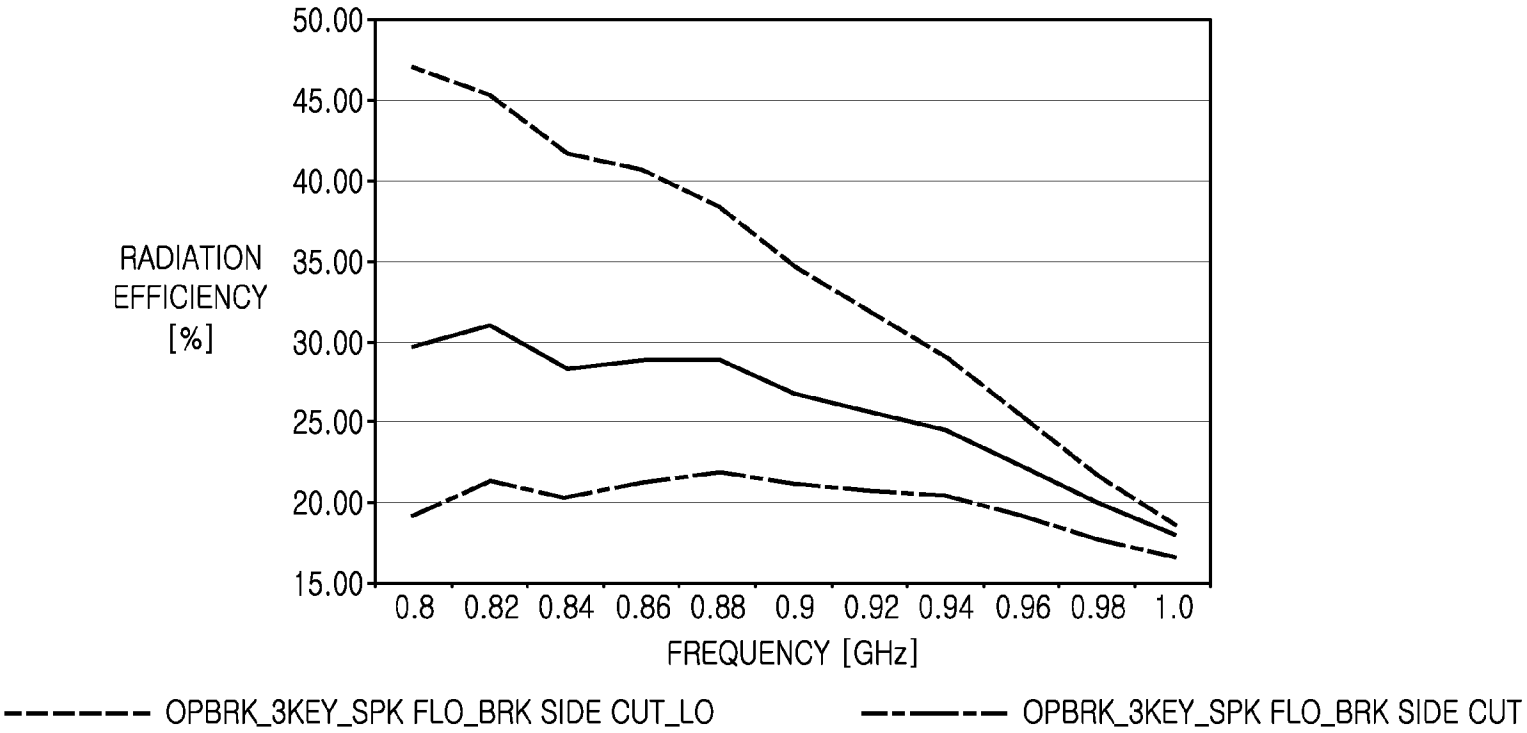

FIGS. 14A and 14B illustrate radiation efficiency for each frequency band of an antenna radiator with respect to different metal frame structures according to exemplary embodiments of the present invention.

The most suitable operation is performed in the case of FIG. 13B in which a slightly open structure is formed by cutting the portion C closest in distance to the feed portion at both the low frequency band and the high frequency band.

Referring to FIGS. 14A and 14B, although there is a relative difference in a radiation property, if any portion of the metal frame is formed to have at least one slightly open structure, more excellent radiation efficiency may be exhibited in comparison with a closed-loop metal frame.

As described above, when a metal frame having a closed structure is implemented to have at least one slightly open structure, a problem occurs in robustness reinforcement which is an original purpose of using the metal frame. Therefore, there is a need to address such a problem.

Figure 15:
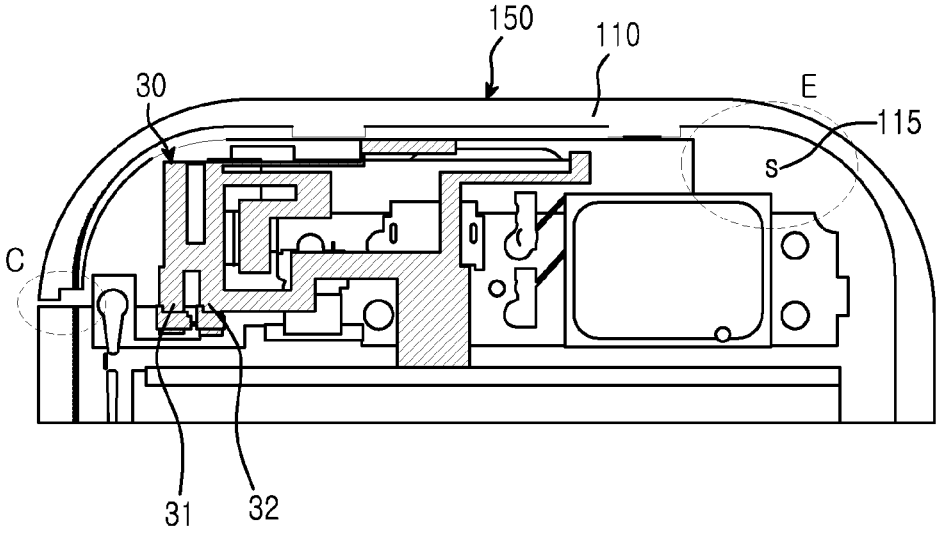
FIG. 15 illustrates a metal frame structure according to an exemplary embodiment of the present invention.

FIG. 15 illustrates a metal frame structure according to an exemplary embodiment of the present invention.

Referring to FIG. 15, a built-in antenna radiator 30 to which a feed portion 31 and a ground portion 32 are electrically connected is disposed inside a portable terminal 150. In addition, a metal frame 110 is disposed along an edge of the built-in antenna radiator 30. In the metal frame 110, a portion C closest in distance to the power-feeding portion 31 of the built-in antenna radiator 30 has a slightly open structure, and a reinforcement portion 115 is further formed inward in a portion E facing the metal frame. The reinforcement portion 115 is for reinforcing mechanical robustness of the metal frame 110, and is formed by being extended by a specific width inward from an end side of the metal frame 110.

Figure 16A:
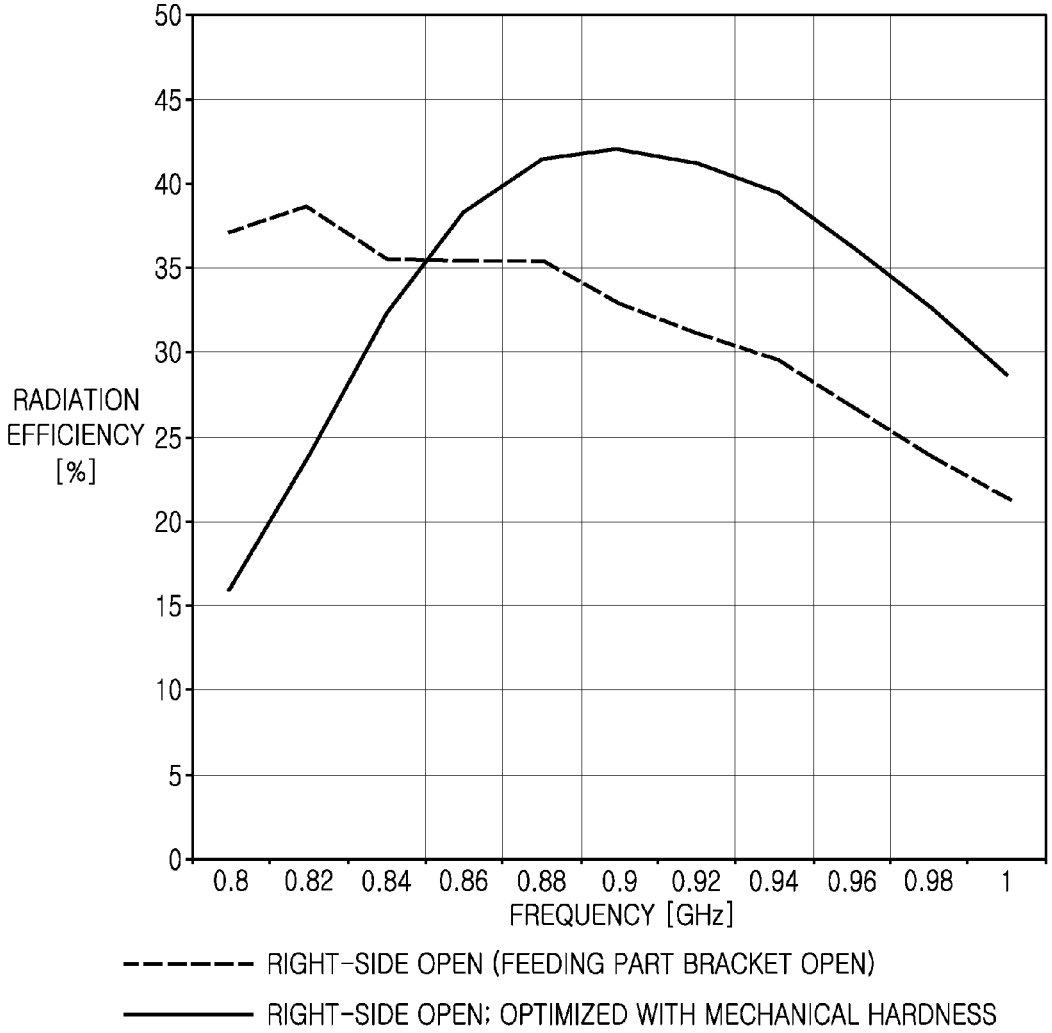
FIGS. 16A and 16B illustrate radiation efficiency for each frequency band of an antenna radiator before and after reinforcement of mechanical robustness according to exemplary embodiments of the present invention.
Figure 16B:
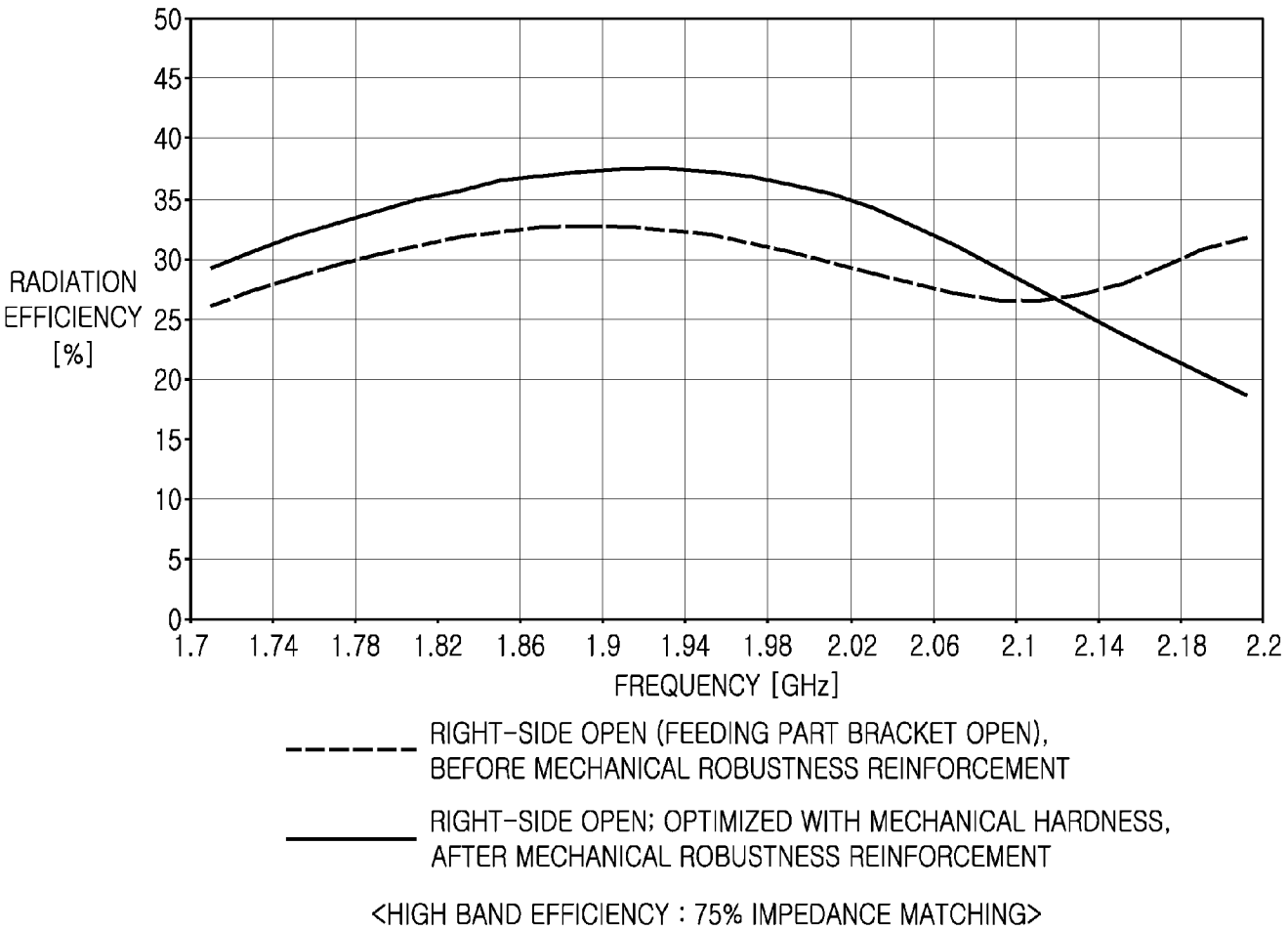

FIGS. 16A and 16B illustrate radiation efficiency for each frequency band of an antenna radiator before and after reinforcement of mechanical robustness according to exemplary embodiments of the present invention.

Referring to FIG. 16A, radiation efficiency is illustrated at a low frequency band. Referring to FIG. 16B, radiation efficiency is illustrated at a high frequency band. As illustrated, it may be seen that there is no significant difference before and after performing reinforcement to reinforce mechanical robustness. That is, a desired radiation property may be implemented even if the aforementioned reinforcement portion is further provided.

According to exemplary embodiments of the present invention, a built-in antenna may exhibit a smooth radiation property even if a metal construction is used in a device, and thus may implement robustness improvement of the device and make the device slim and have an attractive outer appearance. A method of improving antenna efficiency may prevent deterioration of the radiation property of the antenna radiator of the related art by using simple processing, and the metal construction may be used as a radiator.

While the present invention has been shown and described with reference to certain exemplary embodiments thereof, it will be understood by those skilled in the art that various changes in form and details may be made therein without departing from the spirit and scope of the present invention as defined by the appended claims and their equivalents.

What is claimed is:

1. A built-in antenna of a portable terminal, the built-in antenna comprising:

a first conductor having a specific length and used for a ground;

a second conductor disposed with a specific distance in parallel to the first conductor to couple with the first conductor and used for power feeding; and a separating element disposed between the first conductor and the second conductor to separate the first and second conductors, wherein a metal frame is installed along an edge of the portable terminal, and the first conductor and the second conductor are disposed in parallel in a lengthwise direction of the metal frame.

2. The built-in antenna of claim 1, wherein the first conductor and the second conductor are formed by combining one or more of shapes selected from at least one of a linear shape, a curved shape, a zigzag shape, and a multi-curved shape in various directions.

3. The built-in antenna of claim 1, wherein the first conductor and the second conductor have identical or different lengths.

4. The built-in antenna of claim 1, wherein the first conductor is joined with the second conductor in a non-contact manner.

5. The built-in antenna of claim 4, wherein the first conductor has a cross-section formed in at least one of a rectangular shape, a circular shape, an inverted triangular shape, and a multi-curved inverted triangular shape, and the second conductor has a cross-section formed in a shape capable of accommodating the first conductor.

6. The built-in antenna of claim 1, wherein the first and second conductors have a cross-section formed in at least one of a rectangular shape, a circular shape, an inverted triangular shape, and a multi-curved inverted triangular shape.

7. The built-in antenna of claim 1, wherein the first conductor has at least one portion which is grounded to a proper position of the portable terminal.

8. The built-in antenna of claim 1, wherein the second conductor has at least one portion which is used to feed power to a main board of the portable terminal.

9. The built-in antenna of claim 1, wherein the separating element is at least one of a dielectric member, a magnetic member, and a hybrid-type material.

10. The built-in antenna of claim 9, wherein the separating element is disposed between the first conductor and the second conductor such that the conductors have a specific thickness and width in at least one portion.

11. The built-in antenna of claim 9, wherein the first conductor and the second conductor are fixed to the dielectric member in an insert molding manner.

12. The built-in antenna of claim 1, wherein the first conductor is grounded by being electrically connected to the metal frame.

13. The built-in antenna of claim 1, wherein the built-in antenna is fixed to a main board of the portable terminal in such a manner that the antenna is fixed by a specific support member or is directly fixed by being bonded to the main board.

14. The built-in antenna of claim 1, wherein an outer circumferential surface of the first conductor or the second conductor is fully or partially surrounded by any one of a dielectric member, a magnetic member, and a hybrid-type material.

15. The built-in antenna of claim 1, wherein the first conductor and the second conductor are disposed in parallel to each other, and have different cross-sectional shapes and different lengthwise shapes.

16. The built-in antenna of claim 1, wherein the second conductor is grounded by being electrically connected to the metal frame.

* * * * *